United States Patent [19]

Crooks

[11] 4,107,899

[45] Aug. 22, 1978

[54] LOAD-BEARING WALLS AND SIMILAR STRUCTURES

[76] Inventor: Frederick Crooks, 24 Philamere Ave., Glenmore, Durban, Natal, South Africa

[21] Appl. No.: 758,903

[22] Filed: Jan. 12, 1977

Related U.S. Application Data

[63] Continuation-in-part of Ser. No. 574,753, May 5, 1975, abandoned.

[51] Int. Cl.[2] ..... E04G 21/02; E04B 1/16

[52] U.S. Cl. ..... 52/747; 52/258; 52/259; 264/35; 249/18

[58] Field of Search ..... 52/259, 258, 300, 747, 52/236.5, 236.8, 250–253, 262, 263, 741; 264/35; 249/18–22

[56] References Cited

U.S. PATENT DOCUMENTS

| | | | |
|---|---|---|---|
| 963,368 | 7/1910 | Hall | 52/300 |
| 2,250,319 | 7/1941 | Wright | 52/258 |
| 3,744,945 | 7/1973 | Metrailer | 249/18 |

FOREIGN PATENT DOCUMENTS

| | | | |
|---|---|---|---|
| 150,497 | 3/1953 | Australia | 249/19 |
| 248,512 | 3/1926 | United Kingdom | 52/281 |

*Primary Examiner*—James L. Ridgill, Jr.
*Attorney, Agent, or Firm*—Young & Thompson

[57] ABSTRACT

This invention is concerned with a method for erecting a building comprising the steps of locating storey-high relatively thin-walled precast cured concrete panels having substantially L-shaped cross-sections, in a jig corresponding to a floor or portion of a floor of a building, the panels being in opposed and staggered relationship on a suitable base, the base including a channel and the lower edges of the panels being disposed in the channel, and casting a concrete slab or beam on the load-bearing walls thus erected, portions of said slab or beam as cast being disposed on opposite sides of the upper ends of the said panels thereby to lock the panels by the resulting in situ cast concrete slab or beam above them.

1 Claim, 5 Drawing Figures

LOAD-BEARING WALLS AND SIMILAR STRUCTURES

RELATED APPLICATION

This application is a continuation-in-part of co-pending application Ser. No. 574,753, filed 5, 5, 75 now abandoned.

This invention relates to the erection of load-bearing walls.

It is an object of this invention to provide an inexpensive, simple method of erecting such structures, and elements for use in the method.

According to the invention a method for erecting a building comprises the steps of locating storey-high, relatively thin-walled, precast, cured concrete panels having a substantially L-shaped cross-section in a jig corresponding to a floor or portion of a floor of a building, the panels being in opposed and staggered relationship on a suitable base, the base including a channel and the lower edges of the panels being disposed in the channel, and casting a concrete slab or beam on the load-bearing walls thus erected, portions of said slab or beam as cast being disposed on opposite sides of the upper ends of the said panels thereby to lock the panels by the resulting in situ cast concrete slab or beam above them.

In this specification the term L-shaped is intended to means panels that have a portion extending from, and integral with the main plane of the panel. The portion preferably extends substantially at right angles. In a preferred form of the invention the portion extends from the panel along one edge to form a cross-section that is a true L but it will be appreciated that it need not be at the edge, but instead displaced therefrom, in which case the cross-section is substantially in the form of a T.

The spaces between erected panels may if desired be filled with suitable binding material, for example concrete, or insulating materials, or other materials as desired.

The panel may incorporate a filler material, for example an inorganic fibre such as glass fibre or asbestos fibre. In the case of an unreinforced panel, the thickness is preferably of the order of 3 to 5 centimeters. Reinforced panels may however be thinner.

The invention is discussed below with reference to the accompanying drawings in which.

Figure 1:
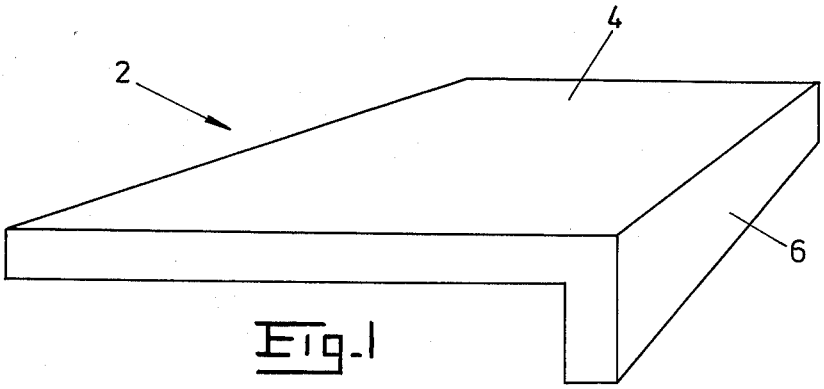
FIG. 1 shows one embodiment of a panel according to the invention.

Referring to the drawings, in FIG. 1 there is shown a building panel 2. The panel 2 is substantially L-shaped in cross-section, comprising a substantially flat, rectangular main portion 4, and extending from one face thereof, substantially at right angles thereto, along one long side thereof, a sub-portion 6.

The panel 2 is comparatively thin-walled, being about 4 centimeters thick, and is precast from concrete which is then cured.

Figure 2:
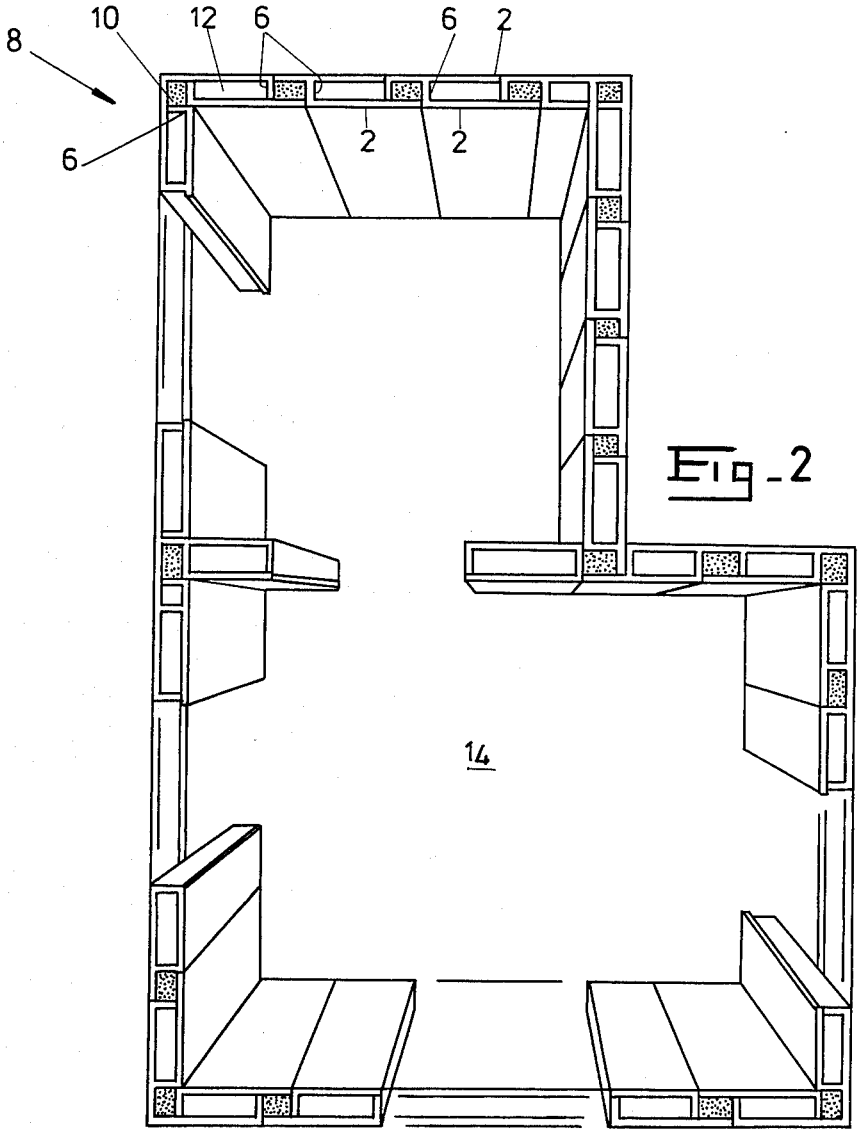
FIG. 2 shows a plan view of walls for a building constructed according to the invention using panels of FIG. 1.
Figure 4:
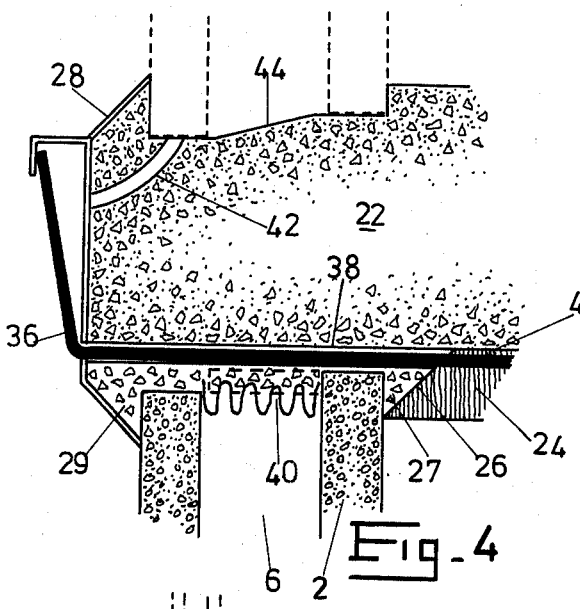
FIG. 4 is a detailed side view of the edge of an in situ cast slab.

Referring to FIG. 2 of the drawings, a building 8 has walls formed from panels 2. Each wall comprises a series of abutting hollow sections, each section comprising a pair of panels 2 located facing each other, the sub-portion 6 of each panel abutting the inside face of the main portion 4 of the opposite panel 2, the two panels further being staggered with respect to each other. The cavities formed between adjacent sections by the sub-portions 6 and projecting portions of the main portions 4 of the panels 2 of the adjacent sections are filled with a concrete 10. The cavities 12 defined within each section however may be left empty (but may, if desired, also be filled in). The walls are erected on a suitable base 14.

Figure 3:
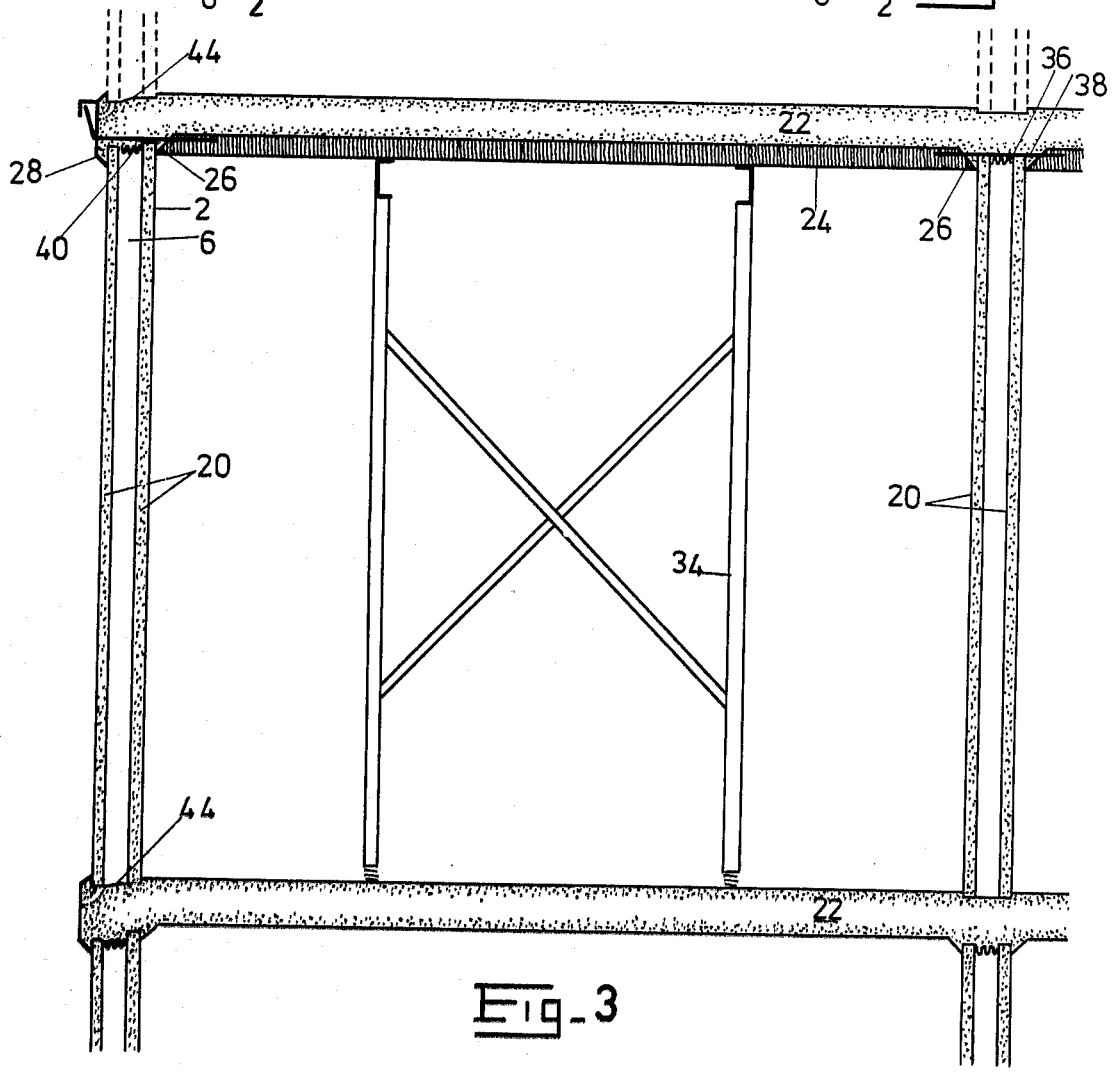
FIG. 3 is a sectional side view illustrating the method of erecting a multi-storey building according to the invention.

In FIG. 3 is shown a portion of a multi-storey building. The first step is the formation of foundations (not shown) which may form part of ground slabs (also not shown) which contains channels 44 as shown in the floor slabs 22.

Considering the lower floor slab as such or as a ground slab, suitable centering supports 34 are located in position. They may be adjustable as to height and they support bearers which, in turn, support deck plates 24. These deck plates may comprise a number of panels able to support the floor slab 22 when cast. The combination of centering supports and support bearers comprises a jig so that the required room size can be formed in a one-step process. The slab 22 may include insulating materials or heating elements to cause rapid curing of the concrete. Fillets 26 may also be included to form pockets of concrete along the wall-ceiling junction to serve as an in situ cast scotia and wall locking element in conjunction with pocket 29.

The face plates 28 (which may be profiled to suit architectural preference) are attached peripherally to the deck by means of stirrups or locking pins 36 passing through plastic or other tubing. These face plates, together with the deck plates 24, comprise formwork for the concrete to be cast, and, together with the edge of the deck, form a channel of predetermined size to accept the next panels 20 for the next higher storey. Channels corresponding to internal rooms are formed by coupling the decks with locking pins 36 passing through portion 38.

It will be appreciated that the assembly may be adjusted on the ground slab and on subsequent floor slabs for perfect levelling by use of a plumbline and is then ready to receive the wall panels 20, whose upper ends are inserted in the above-mentioned formwork. Reinforcing, where necessary, and electrical, plumbing or other services may be included. Formers may be provided in the top of the deck to provide grooves which accept internal non-loadbearing partitions. Drainholes 42 are also provided to bleed off water entering the wall.

The panels 20 are of the order of 4 centimeters thick and are made by locating the concrete mix in a mould within a confined, airtight, insulated space, and allowing it to harden therein, preferably with the aid of heating means incorporated in the base plate of the mould.

Suitable surface textures, colouring matter, conduits for services and liners for door or window orifices may be provided.

In order to prevent unwanted wet concrete from entering the space between adjacent panels, blocking 40 is provided. However, it may be desired to fill the space with concrete or with reinforced concrete or an insulating material. For example, aluminium foil stuck onto the internal panel is effective in very cold climates.

Once the slab 22 has been poured and set it locks the whole structure together. The formation of channel 44 enables the next higher storey to be constructed. The floor surface is finished according to requirements.

It will be appreciated that curing process for the slabs may be carried out within a confined, air-tight insulated space and with the optional provision of heating means. This results in the utilisation of the exothermic energy of the curing reaction to accelerate the curing process to a degree where a 24 hours cast and strip cycle can be achieved.

Figure 5:
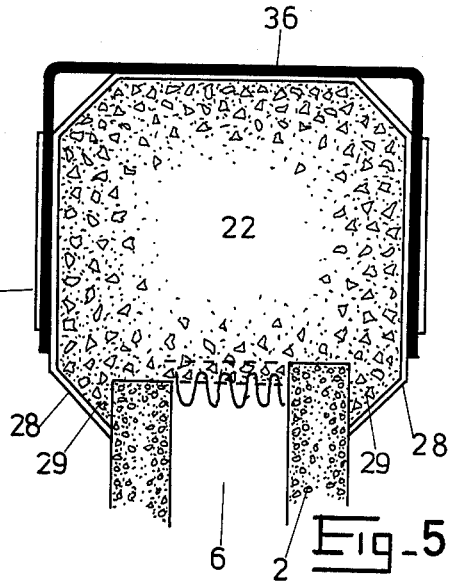
FIG. 5 is a detailed side view of the end of a beam cast in situ on the walls.

Referring now to FIG. 5, at roof level one may use two faceplates 28 comprising concrete formwork to form an in situ cast ring beam to lock the wall panels 20 together and the walls into a structure as a whole. Roof tiles and other architectural features may be incorporated.

It was a surprising finding that such thin panels could be used for multi-storey buildings and that the buildings exhibit considerable resistance to both axial (vertical) and horizontal (wind) loading.

I claim:

1. A method of erecting a building, comprising erecting a jig, placing concrete formwork on said jig, inserting in said formwork the upper ends of storey-high relatively thin-walled precast cured concrete panels having a substantial L-shape in cross-section, placing the panels in opposed and staggered relation to each other, placing the lower ends of the panels in a channel in a base which is below said formwork, the panels extending vertically between the base and the formwork, the formwork extending down below the upper ends of the panels to form pockets on opposite sides of the upper ends of the panels, casting concrete into said formwork to a depth to fill said pockets and to overlie the upper ends of the panels, whereby the concrete, upon setting, locks the panels together to form load-bearing walls in the completed structure.

* * * * *